US006676522B2

(12) United States Patent
Rowe et al.

(10) Patent No.: US 6,676,522 B2
(45) Date of Patent: Jan. 13, 2004

(54) GAMING SYSTEM INCLUDING PORTABLE GAME DEVICES

(75) Inventors: Rick Rowe, Reno, NV (US); Mike Oberberger, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/882,559

(22) Filed: Jun. 15, 2001

(65) Prior Publication Data

US 2001/0044337 A1 Nov. 22, 2001

Related U.S. Application Data

(63) Continuation-in-part of application No. 09/544,884, filed on Apr. 7, 2000.

(51) Int. Cl.[7] ..... A63F 9/24
(52) U.S. Cl. ..... 463/42; 463/16; 463/25
(58) Field of Search ..... 463/40–42, 16, 463/25

(56) References Cited

U.S. PATENT DOCUMENTS

| | | | | |
|---|---|---|---|---|
| 5,129,652 A | | 7/1992 | Wilkinson | |
| 5,265,874 A | | 11/1993 | Dickinson et al. | |
| 5,382,784 A | * | 1/1995 | Eberhardt | 235/472 |
| 5,557,086 A | | 9/1996 | Schulze et al. | |
| 5,618,045 A | | 4/1997 | Kagan et al. | |
| 5,643,086 A | | 7/1997 | Alcorn et al. | |
| 5,678,886 A | | 10/1997 | Infanti | |
| 5,738,583 A | | 4/1998 | Comas et al. | |
| 5,741,183 A | | 4/1998 | Acres et al. | |
| 5,761,647 A | | 6/1998 | Boushy | |
| 5,768,382 A | | 6/1998 | Schneier et al. | |
| 5,770,533 A | * | 6/1998 | Franchi | 463/16 |
| 5,779,545 A | | 7/1998 | Berg et al. | |
| 5,795,228 A | | 8/1998 | Trumbull et al. | |
| 5,797,085 A | | 8/1998 | Beuk et al. | |

(List continued on next page.)

FOREIGN PATENT DOCUMENTS

| | | |
|---|---|---|
| DE | 195 02 613 A1 | 1/1995 |
| WO | 95/24689 | 9/1995 |
| WO | 96/00950 | 11/1996 |

OTHER PUBLICATIONS

U.S. patent application Ser. No. 09/544,884, Rowe et al., filed Apr. 7, 2000.

*Primary Examiner*—Michael O'Neill
*Assistant Examiner*—Julie Brocketti
(74) *Attorney, Agent, or Firm*—Welde & Miller, Ltd.

(57) ABSTRACT

A gaming system including hand-held, portable gaming devices is disclosed. In one embodiment, the gaming system is arranged to present at least one game to a player and includes a portable gaming device or interface having a display for displaying game and other information to a player. The portable gaming device is capable of receiving and sending information to a remote device/location. A game server generates game data, and transmits the game data to the portable gaming device and receives information, such as player input, from the portable gaming device. A payment transaction server validates payment and establishes entitlement of a player to play a game via the portable gaming device as provided by the game server. In one or more embodiments, the gaming system includes one or more stationary gaming machines capable of printing tickets having a value associated therewith. The portable gaming device includes a ticket reader for reading ticket information for use by the payment transaction server in verifying the associated value for establishing entitlement of a player to play the game. Preferably, communication to and from the portable gaming device is via a wireless communication channel.

9 Claims, 6 Drawing Sheets

U.S. PATENT DOCUMENTS 5,871,398 A 2/1999 Schneier et al.
5,915,023 A 6/1999 Bernstein
5,999,808 A * 12/1999 LaDue ..... 235/380
6,001,016 A 12/1999 Walker et al.
6,012,832 A 1/2000 Saunders et al.
6,012,983 A 1/2000 Walker et al.
6,019,283 A 2/2000 Lucero
6,048,269 A * 4/2000 Burns et al. ..... 463/25
6,093,100 A 7/2000 Singer et al.
6,104,815 A 8/2000 Alcorn et al.
6,106,396 A 8/2000 Alcorn et al.
6,110,041 A 8/2000 Walker et al.
6,149,522 A 11/2000 Alcorn et al.
6,270,410 B1 * 8/2001 DeMar et al. ..... 273/143 R
6,280,326 B1 * 8/2001 Saunders ..... 235/379
6,285,868 B1 9/2001 LaDue
6,340,331 B1 * 1/2002 Saunders et al. ..... 235/380

* cited by examiner

GAMING SYSTEM INCLUDING PORTABLE GAME DEVICES

RELATED APPLICATIONS

This application is a continuation-in-part of U.S. application Ser. No. 09/544,884, filed Apr. 7, 2000.

FIELD OF THE INVENTION

The present invention relates to gaming devices, and more particularly to a gaming system which supports portable gaming devices.

BACKGROUND OF THE INVENTION

Gaming is ever more popular, and casinos and other gaming establishments continually seek new and exciting ways to present games for play. Currently, games are generally presented on large free-standing gaming devices, such as the well known slot machine and video poker machine. Some games are presented at other than a gaming device, such as the table games of craps, blackjack and roulette. In addition, games such as keno and bingo may be played from tables in areas specially configured to present the game to players (such as in an area where personnel are arranged to pick up keno cards and called numbers are displayed on large displays.

A substantial disadvantage to the way such games are currently presented is that a player may participate in the game in only certain locations. For example, in order to play video poker, a player may be required to travel through a large hotel/casino to a specific gaming area where the video poker machine is located.

Gaming operators desire to provide to their customers greater accessibility to gaming devices and the opportunity to play games.

SUMMARY OF THE INVENTION

A gaming system including hand-held personal gaming devices is disclosed. The gaming system is adapted to present one or more games to a user of one of the hand-held gaming devices.

In one embodiment, the gaming system includes a portable gaming device or interface. The portable gaming device has a display for displaying game information to a player, at least one input device for receiving input from the player and is capable of receiving and sending information to a remote device/location. The gaming system also includes a game server for generating game data, transmitting game data to the portable gaming device and receiving information, such as player input, from the portable gaming device. The gaming system further includes a payment transaction server for validating payment and establishing entitlement of a player to play a game via the portable gaming device as provided by the game server.

In one or more embodiments, the gaming system includes one or more stationary gaming machines or other devices capable of printing tickets having a value associated therewith. The portable gaming device includes a ticket reader for reading ticket information for use by the payment transaction server in verifying the associated value for permitting the player to play the game.

In one or more embodiments, the portable gaming devices communicate with other devices (such as the game server) via a wireless communication channel. Appropriate relays and transceivers are provided for permitting the wireless communication.

In one or more embodiments, the portable gaming device includes a plurality of interfaces for changing the configuration of the gaming device or interacting with one or more transaction servers. In one embodiment, a login interface is provided for receiving login information regarding a user of the device. In one embodiment, the number of interfaces or other functions or features displayed or permitted to be accessed are configured depending upon the user of the device. In the event a gaming representative identifies themselves, interfaces permitting access to a variety of control functions may be provided. In the event a player identifies themselves, such control functions may not be accessible, but instead only consumer-related functions may be accessible such as game play.

In one or more embodiments the gaming system includes one or more transaction servers, such as a food transaction server. Using an interface of the portable gaming device a player or other user may request services from the food transaction server. For example, a player may request food, drink, a restaurant reservation or other service.

One or more embodiments of the invention comprise a method of playing a game via a portable gaming device associated with a gaming network. In one embodiment, a player obtains a portable gaming device, such as by checking out the device from the hostess station of a restaurant or the front desk of a hotel/casino. The player provides value to the gaming operator, such as a credit card or cash deposit. This value is associated with the server and matched with a ticket number, player tracking number or other identifier.

The game device is configured for player play using the login interface. The act of logging in may be performed by the player or the gaming operator. The player next establishes entitlement to obtain services, such as the playing of a game, by showing the existence of value. In one embodiment, the player scans their ticket using the ticket reader of the device. The scanned information is transmitted to the payment transaction server for verifying entitlement of the player to play a game or obtain other services. In the event the entitlement is verified, then the player is permitted to engage in the play of a game or request service.

In the event a player wishes to play a game, the player indicates such by selecting a particular game using a game play interface. Upon receipt of such an instruction, the game server generates game data and transmits it to the personal gaming device. The transmitted data may comprise sound and video data for use by the personal gaming device in presenting the game. The player is allowed to participate in the game by providing input to the game server through the personal gaming device. The game server determines if the outcome of the game is a winning or losing outcome. If the outcome is a winning outcome, an award may be given. This award may be cash value which is associated with the player's account at the payment transaction server. If the outcome is a losing outcome, then a bet or wager placed by the player may be lost, and that amount deducted from the player's account at the transaction server.

Further objects, features, and advantages of the present invention over the prior art will become apparent from the detailed description of the drawings which follows, when considered with the attached figures.

DESCRIPTION OF THE DRAWINGS

FIG. 4(*b*) is a flow diagram of a particular method of using the portable gaming device of the invention by a player;

DETAILED DESCRIPTION OF THE INVENTION

In general, the present invention is a gaming system. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
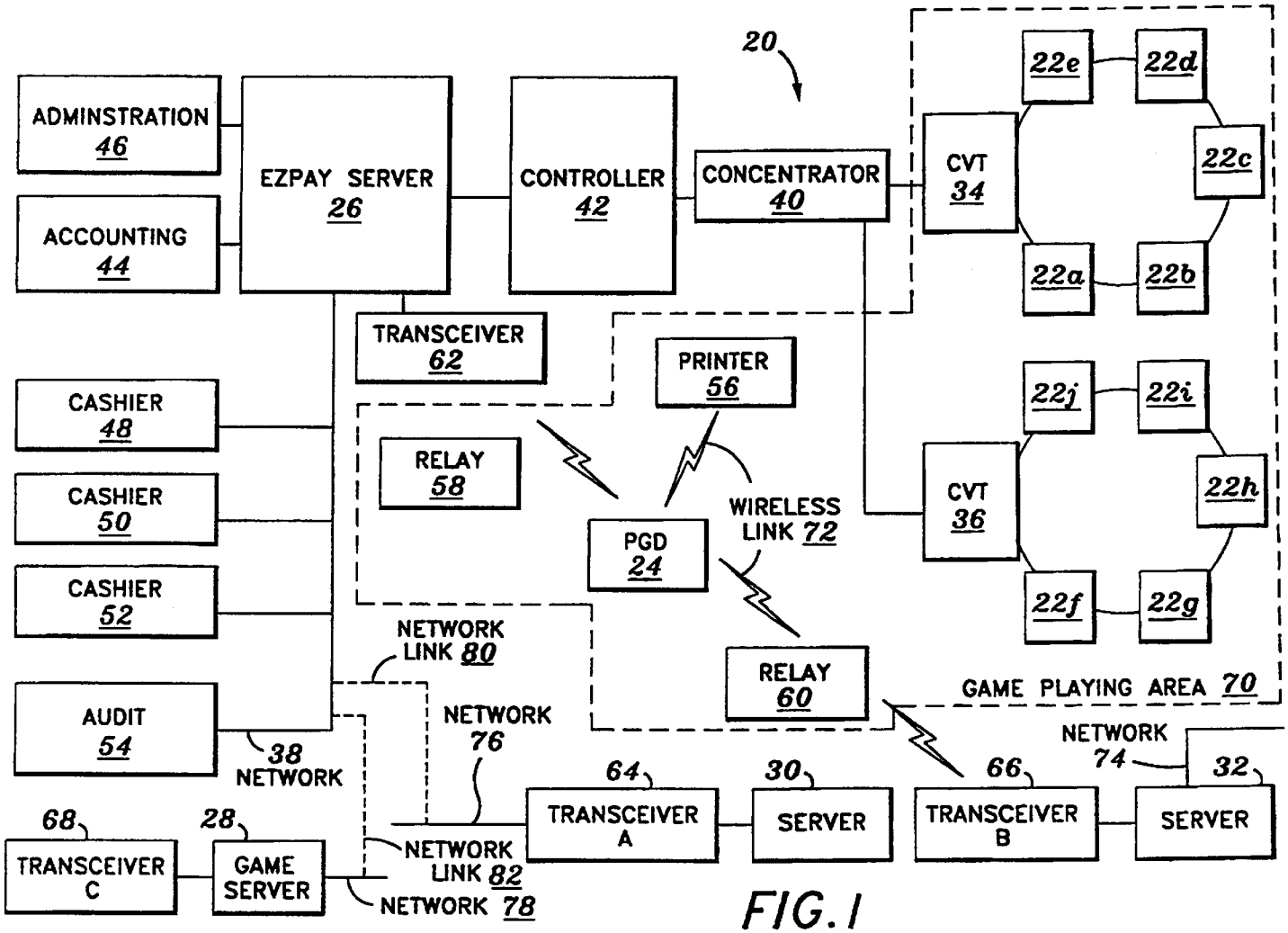
FIG. 1 is a block diagram of a gaming system in accordance with an embodiment of the invention.

FIG. 1 is a block diagram of a gaming system in accordance with one embodiment of the invention. The various aspects of the gaming system will first be described in overview, and then in more detail below.

As illustrated, the gaming system 20 includes a plurality of gaming machines 22*a*, 22*b*, 22*c*, 22*d*, 22*e*, 22*f*, 22*g*, 22*h*, 22*i*, 22*j*. In a preferred embodiment, these gaming machines 22*a*, 22*b*, 22*c*, 22*d*, 22*e*, 22*f*, 22*g*, 22*h*, 22*i*, 22*j* are of the stationary type. In general, the gaming machines 22*a*, 22*b*, 22*c*, 22*d*, 22*e*, 22*f*, 22*g*, 22*h*, 22*i*, 22*j* are arranged to present one or more games to a player. Preferably, the games are of the type requiring the placement of a wager or bet and are of the type by which a player receiving a winning outcome is provided an award, such as a monetary award. These devices may comprise for example, video poker and slot machines. In addition, the gaming system 20 includes one or more hand-held, portable gaming devices (PGDs) 24. The PGD 24 is also arranged to present one or more games to a player, and as described below, may be used as an access point for a variety of other services. The device referred to herein as a "personal gaming device" may be referred to by other terminology, such as a portable gaming interface, personal game unit or the like, but regardless of the name of the device, such preferably has one or more of the characteristics herein.

In addition, in a preferred embodiment, the PGD 24 is in communication with at least one gaming server 28. As described below, in a preferred embodiment, the one or more games which are presented via the PGD 24 to the player are provided by the gaming server 28.

The gaming machines 22*a*, 22*b*, 22*c*, 22*d*, 22*e*, 22*f*, 22*g*, 22*h*, 22*i*, 22*j* and each PGD 24 is in communication with a payment system referred to herein as the "EZ-Pay" system. This system includes a server 26 for receiving and transmitting information. In general, the EZ Pay system is utilized to accept payment from a player for the playing of games and obtaining of other goods and services, and for paying a player winnings or awards.

In the embodiment illustrated, the gaming system 20 includes other servers 30,32 for transmitting and/or receiving other information. In one embodiment, as described below, one server 30 comprises a prize transaction server. Another server 32 comprises a food transaction server. In a preferred embodiment, information may be transmitted between the PGD 24 and these servers 30,32.

The EZ Pay system will now be described in more detail with reference to FIG. 2. In general, the EZ Pay system is an award ticket system which allows award ticket vouchers to be dispensed in lieu of the traditional coin awards or reimbursements when a player wins a game or wishes to cash out. These tickets may also be used by gaming machines and other devices for providing value, such as for payment of goods or services including as a bet or ante for playing a game.

Figure 2:
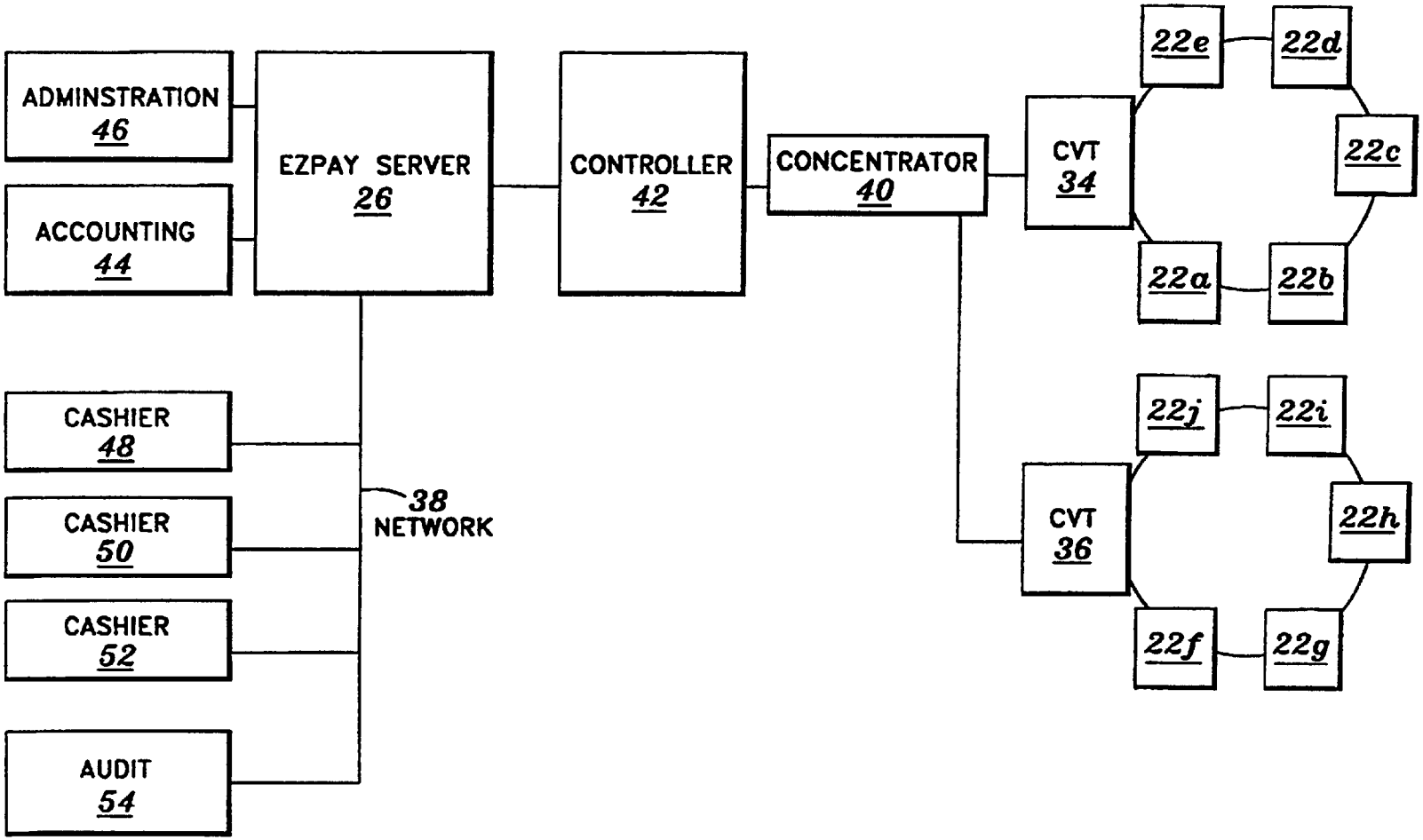
FIG. 2 is a block diagram of a payment system forming a part of the gaming system illustrated in FIG. 1.

FIG. 2 illustrates one embodiment of such a system in block diagram form. As illustrated, a first group of gaming machines 22*a*, 22*b*, 22*c*, 22*d*, and 22*e* is shown connected to a first clerk validation terminal (CVT) 34 and a second group of gaming machines 22*f*, 22*g*, 22*h*, 22*i*, and 22*j* is shown connected to a second CVT 36. All of the gaming machines print ticket vouchers which may be exchanged for cash or accepted as credit or indicia in other gaming machines. When the CVTs 34,36 are not connected to one another, a ticket voucher printed from one gaming machine may only be used as indicia of credit in another gaming machine which is in a group of gaming machines connected to the same CVT. For example an award ticket printed from gaming machine 22*a* might be used as credit of indicia in gaming machines 22*b*, 22*c*, 22*d*, and 22*e*, which are connected to the common CVT 34, but may not be used in gaming machines 22*f*, 22*g*, 22*h*, 22*i*, and 22*j* since they are each connected to the CVT 36.

The CVTs 34,36 store ticket voucher information corresponding to the outstanding ticket vouchers that are waiting for redemption. This information is used when the tickets are validated and cashed out. The CVTs 34,36 store the information for the ticket vouchers printed by the gaming machines connected to the CVT. For example, CVT 34 stores ticket voucher information for ticket vouchers printed by gaming machines 22*a*, 22*b*, 22*c*, 22*d*, and 22*e*. When a player wishes to cash out a ticket voucher and the CVTs 34,36 are not connected to one another, the player may redeem a voucher printed from a particular gaming machine at the CVT associated with the gaming machine. To cash out the ticket voucher, the ticket voucher is validated by comparing information obtained from the ticket with information stored with the CVT. After a ticket voucher has been cashed out, the CVT marks the ticket as paid in a database to prevent a ticket voucher with similar information from being cashed multiple times.

Multiple groups of gaming machines connected to the CVTs 34,36 may be connected together in a cross validation network 38. The cross validation network typically comprises one or more concentrators 40 which accept input from two or more CVTs and enables communications to and from the two or more CVTs using one communication line. The concentrator 40 is connected to a front end controller 42 which may poll the CVTs 34,36 for ticket voucher information. The front end controller 42 is connected to an EZ pay server 26 which may provide a variety of information services for the award ticket system including accounting 44 and administration 46.

The cross validation network allows ticket vouchers generated by any gaming machine connected to the cross validation network to be accepted by other gaming machines in the cross validation network 38. Additional, the cross validation network allows a cashier at a cashier station 48, 50, 52 to validate any ticket voucher generated from a gaming machine within the cross validation network 38. To cash out a ticket voucher, a player may present a ticket voucher at one of the cashier stations 48, 50, 52. Information obtained from the ticket voucher is used to validate the ticket by comparing information on the ticket with information stored on one of the CVTs 34,36 connected to the cross validation network 38. As tickets are validated, this information may be sent to another computer 54 providing audit services.

As described above, the gaming system 20 of the present invention also includes one or more hand-held PGDs 24. One or more embodiments of a PGD 24 are described in detail below. In one embodiment, the PGD 24 is a portable device capable of transmitting and receiving information via a wireless communication link/network.

Referring again to FIG. 1, the gaming system 20 also preferably includes a printer 56, wire-less communication relays 58 and 60, and wire-less transceivers 62, 64, 66 and 68 connected to the remote transaction servers 26, 28, 30 and 32. As described below, a player may obtain the PGD 24, and after being provided with the appropriate authority, may play one or more games and/or obtain other services including food services or accommodation services.

Figure 3:
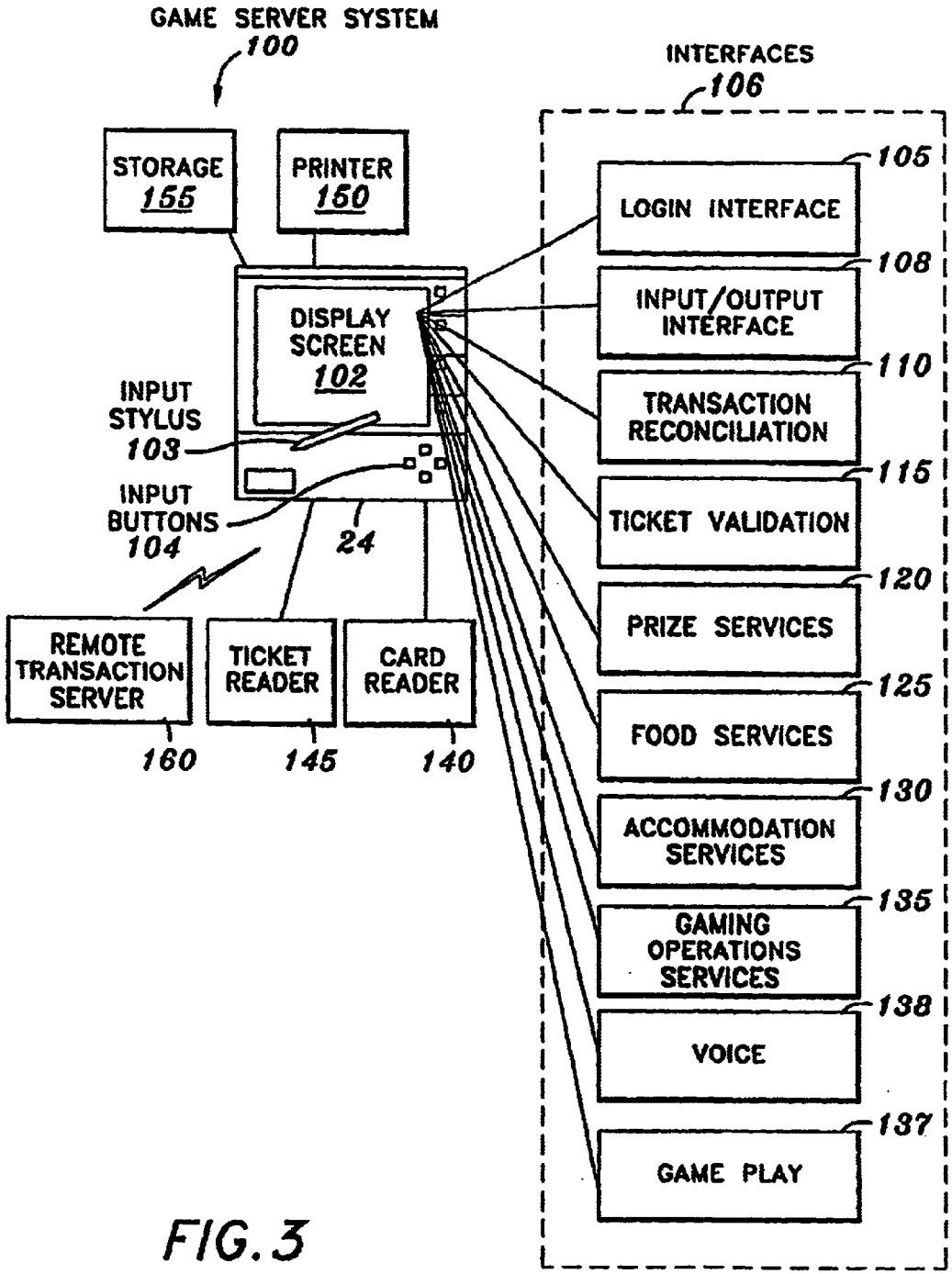
FIG. 3 is a schematic diagram of a portable gaming device of the gaming system illustrated in FIG. 1.

FIG. 3 illustrates the PGD 24 and a block diagram of a game and service system which may be implemented by the gaming system 20 illustrated in FIG. 1. In one embodiment, the game and service system 100 is comprised of at least one PGD 24 and a number of input and output devices. The PGD 24 is generally comprised of a display screen 102 which may display a number of game service interfaces 106. These game service interfaces 106 are generated on the display screen 102 by a microprocessor of some type (not shown) within the PGD 24. Examples of a hand-held PGD 24 which may accommodate the game service interfaces 106 shown in FIG. 3 are manufactured by Symbol Technologies, Incorporated of Holtsville, N.Y. The interface or menu data may be stored in a local memory, or the data may be transmitted to the PGD 24 from a remote location (such as a data server). This reduces the memory requirement of the device.

The game service interfaces 106 may be used to provide a variety of game service transactions and gaming operations services, including the presentation for play by a user of one or more games. The game service interfaces 106, including a login interface 105, an input/output interface 108, a transaction reconciliation interface 110, a ticket validation interface 115, a prize services interface 120, a food services interface 125, an accommodation services interface 130, a gaming operations interface 135, and a game play interface 137 may be accessed via a main menu with a number of sub-menus that allow a game service representative or player to access the different display screens relating to the particular interface.

In one or more embodiments, some or all of the interfaces may be available to a user of the PGD 24. For example, in one or more embodiments, the PGD 24 may have a dual purpose of both being usable by a player to play games and engage in other activities, and also be used by gaming operations personnel for use in providing services to players and performing administrative functions. In alternative embodiments, certain PGDs 24 may be specially configured for use only by players, and other PGDs 24 may be specially configured for use only by gaming or other personnel. In such event, the interfaces 106 may be custom programmed.

In one or more embodiments, only certain interfaces 106 may be displayed, depending on the status of the user of the PGD 24. In one embodiment, the particular interfaces 106 which are displayed and thus accessible for use are determined by the status of the user as indicated through a login function. In a preferred embodiment, when the PGD 24 is operable (such as when a power button is activated) the default status for the PGD 24 is the display of the login interface 105. Once a user of the PGD 24 has logged in, then the status of the PGD display is changed.

In one or more embodiments, the login interface 105 may allow a game service representative to enter a user identification of some type and verify the user identification with a password. When the display screen 102 is a touch screen, the user may enter the user/operator identification information on a display screen comprising the login interface 105 using an input stylus 103 and/or using one or more input buttons 104. Using a menu on the display screen of the login interface, the user may select other display screens relating to the login and registration process. For example, another display screen obtained via a menu on a display screen in the login interface may allow the PGD 24 to scan a finger print of the game service representative for identification purposes or scan the finger print of a game player.

In the event a user identifies themselves as a gaming operator or representative, then the PGD 24 may be arranged to display one or more other interfaces such as those listed above and described in detail below. In one or more embodiments, the default status or login may be a "player" mode login.

In one embodiment, the login interface 105 may allow a player to identify themselves to configure the PGD 24 to permit the player to access a plurality of player services, such as playing games and the like. In one embodiment, the login interface 105 includes a request that the user identify themselves as a "player" or "authorized personnel." In the event "authorized personnel" is selected, then the above-referenced user identification (including password) may be requested. If "player" is selected, then in a preferred embodiment the player is requested to provide an EZ pay ticket. As described in more detail below, in a preferred embodiment of the invention, a player who wishes to play one or more games or obtain other goods or services uses an EZ pay ticket to provide the credit or payment therefor. The ticket may be obtained from a cashier or by play of another gaming device (such as devices 22*a*, 22*b*, 22*c*, 22*d*, 22*e*, 22*f*, 22*g*, 22*h*, 22*i*, 22*j* in FIG. 1). The ticket may be verified through the EZ pay system described above.

In one embodiment, the PGD 24 includes a ticket reader 145 and a card reader 140. In one embodiment, the ticket reader 145 may be of a variety of types. In one embodiment, the reader comprises a bar-code reading optical scanner. In this arrangement, a user of the PGD 24 may simply pass the bar-coded ticket in front of the bar-code reader. In one embodiment, the card reader 140 comprises a magnetic-stripe card type reader for reading information associated with a magnetic stripe of a card, such as a player tracking card.

After having provided the appropriate authorization, access may be provided to the user of the PGD 24 of one or more of the following interfaces 106.

In one or more embodiments, an authorized user may be provided with access to the input/output interface 108. In a preferred embodiment, such access is only provided to a game service operator and not a player. In one or more embodiments, the input/output interface 108 permits a user to select, from a list of devices stored in memory on the PGD 24, a device from which the PGD may input game service transaction information or output game service transaction information. For example, the PGD 24 may communicate with the ticket reader 145. As another example, the PGD 24 may input information from the card reader 140. Such input may be useful, for example, if a game service operator wishes to verify the authenticity of a player tracking card or the like.

The PGD 24 may output game and service transaction information to a number of devices. For example, to print a receipt, the PGD 24 may output information to a printer 150. In this game service transaction, the PGD 24 may send a print request to the printer 150 and receive a print reply from the printer 150. The printer 150 may be a large device at some fixed location or a portable device carried by the game service representative. As another example, the output device may be the card reader 140 that is able to store information on a magnetic card or smart card. Other devices which may accept input or output from the PGD 24 are personal digital assistants, microphones, keyboard, storage devices, gaming machines and remote transaction servers.

The PGD 24 may communicate with the various input mechanisms and output mechanisms using both wire and wire-less communication interfaces. For example, the PGD 24 may be connected to the printer 150 by a wire connection of some type. However, the PGD 24 may communicate with a remote transaction server 160 via a wire-less communication interface including a spread spectrum cellular network communication interface. An example of a spread spectrum cellular network communication interface is Spectrum 24 offered by Symbol Technologies of Holtsville, N.Y., which operates between about 2.4 and 2.5 Gigahertz. The information communicated using the wire-less communication interfaces may be encrypted to provide security for certain game service transactions such as validating a ticket for a cash pay out. Some devices may accommodate multiple communication interfaces. Such a spread spectrum network is but one possible communication scheme.

Another type of interface that may be stored on the PGD 24 is the award ticket validation interface 115. In a preferred embodiment, this interface is only available to an authorized game service representative, and not a player. One embodiment of the award ticket interface 115 may accommodate the EZ pay ticket voucher system and validate EZ pay tickets as previously described. However, when other ticket voucher systems are utilized, the award ticket validation interface 115 may be designed to interface with the other ticket voucher systems. Using the award ticket validation interface 115, a game service representative may read information from a ticket presented to the game service representative by a game player using the ticket reader and then validate and pay out an award indicated on the ticket.

Typically, the award ticket contains game service transaction information which may be verified against information stored on a remote transaction server 160. To validate the ticket may require a number of game service transactions. For example, after obtaining game service transaction information from the award ticket, the PGD 24 may send a ticket validation request to the remote transaction server 160 using the spread spectrum communication interface and receive a ticket validation reply from the remote server 160. In particular, the validation reply and the validation request may be for an EZ pay ticket. After the award ticket has been validated, the PGD 24 may send a confirmation of the transaction to the remote server 160. Details of the game service transaction information validation process are described with the reference to FIG. 5. In other embodiments, the award ticket interface may be configured to validate award information from a smart card or some other portable information device or validate award information directly from a gaming machine.

As game and service transactions are completed, game and service transaction information may be stored on a storage device 155. The storage device 155 may be a remote storage device or a portable storage device. The storage device 155 may be used as a back-up for auditing purposes when the memory on the PGD 24 fails and may be removable from the PGD 24.

Another type of game service interface that may be stored on the PGD 24 is the prize service interface 120. As an award on a gaming machine (i.e., machines 22*a*, 22*b*, 22*c*, 22*d*, 22*e*, 22*f*, 22*g*, 22*h*, 22*i*, 22*j* in FIG. 1) or while playing a game via the PGD 24, a game player may receive a ticket (such as issued by other machine) that is redeemable for merchandise including a bicycle, a computer or luggage or receive such an award directly (such as while playing the PGD 24 itself). Using the prize service interface 120, a game service representative or player may validate the prize service ticket and then check on the availability of certain prizes. For example, when the prize service ticket indicates the game player has won a bicycle, the game service representative may check whether the prize is available in a nearby prize distribution center. Alternatively, a player may be permitted to do the same thing. In one embodiment, a player may be awarded a prize of a particular level, there being one or more particular prizes on that level. In such event, the player may use the interface 120 to determine what prizes are currently available in the prize level just awarded. The PGD 24 may validate a prize ticket and check on the availability of certain prizes by communicating with a remote prize server. Further, the game service representative may have the prize shipped to a game player's home or send a request to have the prize sent to a prize distribution location. The game service transactions needed to validate the prize ticket including a prize validation request and a prize validation reply, to check on the availability of prizes and to order or ship a prize may be implemented using various display screens located within the prize interface. The different prize screens in the prize service interface 120 may be accessed using a menu located on each screen of the prize service interface. In other embodiments, the prize service interface 120 may be configured to validate prize information from a smart card or some other portable information device or validate award information directly from a gaming machine.

Another type of game service interface that may be stored on the PGD 24 is the food service interface 125. As an award on a gaming machine or as compensation for a particular amount of game play, a game player may receive a free food or drink. Using the food service interface 125, the player may redeem the food or drink award, or a game service representative may validate such an award (for example, the award may be provided to a player of a gaming device 22*a* in the form of a ticket) and check on the availability of the award. For example, when the game player has received an award ticket valid for a free meal, the food service interface may be used to check on the availability of a dinner reservation and make a dinner reservation. As another example, the PGD 24 may be used to take a drink or food order by the player thereof. Such an order may be processed via the remote food server 32 (see also FIG. 1). The transactions needed to validate a food ticket or award, to check on the availability of food services, request a food service and receive a reply to the food service request may be implemented using various display screens located within the food service interface 125. These display screens may be accessed using a menu located on each screen of the food service interface. In other embodiments, the food service interface may be configured to validate food service information from a smart card or some other portable information device.

Another type of game service interface that may be stored on the PGD 24 is an accommodation service interface 130. As an award for game play or as compensation for a particular amount of game play, a game player may receive an award in the form of an accommodation service such as a room upgrade, a free night's stay or other accommodation prize. using the accommodation service interface 130, the player may check on the availability of certain accommodation prizes. For example, when the game player has received an award for a room upgrade, the accommodation service interface may be used to check on the availability of a room and to make a room reservation. Regardless of whether the player has won an accommodation award, the player may utilize the accommodation service interface 130 to reserve a room (such as an additional night's stay) or an upgrade to a room. In one embodiment, a player of a game may be issued a ticket (such as from a free-standing game device 22*a*, 22*b*, 22*c*, 22*d*, 22*e*, 22*f*, 22*g*, 22*h*, 22*i*, 22*j* in FIG. 1), and a gaming representative may use the accommodation service interface 130 in order to validate the player's award ticket and check on the availability of the award and institute the award. As another example, the PGD 24 may be used to order a taxi or some other form of transportation for a player at a gaming machine preparing to leave the game playing area. The game playing area may be a casino, a hotel, a restaurant, a bar or a store.

The PGD 24 may validate the accommodation service award and check on the availability of certain accommodation awards by communicating with a remote accommodation server. The transactions needed to validate the accommodation ticket, check on the availability of accommodation services, request an accommodation service and receive a reply to the accommodation service request may be implemented using various display screens located within the accommodation service interface. These display screens may be accessed using a menu located on each screen of the accommodation service interface. In other embodiments, the accommodation service interface may be configured to validate accommodation service information from a smart card or some other portable information device.

Another type of game service interface that may be stored on the PGD 24 is a gaming operations service interface 135. Using the gaming service interface 135 on the PGD 24, a game service representative may perform a number of game service transactions relating to gaming operations. For example, when a game player has spilled a drink in the game playing area, a game service representative may send a request to maintenance to have someone clean up the accident and receive a reply from maintenance regarding their request. The maintenance request and maintenance reply may be sent and received via display screens selected via a menu on the screens of the gaming operations service interface. As another example, when a game service representative observes a damaged gaming machine such as a broken light, the game service representative may send a maintenance request for the gaming machine using the PGD 24. In one or more embodiments, a player may be permitted various options through the gaming service interface 135. For example, a player may be permitted to request a gaming service representative or attendant using the interface 135.

Another type of game service interface that may be stored on the PGD 24 is a transaction reconciliation interface 110. Typically, the PGD 24 contains a memory storing game service transaction information. The memory may record the type and time when a particular game service transactions are performed. At certain times, the records of the game service transactions stored within the PGD 24 may be compared with records stored at an alternate location. For example, for an award ticket validation, each time an award ticket is validated and paid out, a confirmation is sent to a remote server 160. Thus, information regarding the award tickets, which were validated and paid out using the PGD 24, should agree with the information regarding transactions by the PGD stored in the remote server 160. The transaction reconciliation process involves using the transaction reconciliation interface 110 to compare this information. Preferably, only a gaming service representative (and not a player) is permitted access to the transaction reconciliation interface 110.

Another type of game service interface that may be stored on the PGD 24 is a voice interface 138. Using the spread spectrum cellular or other communication network incorporated into the PGD, a player and/or game service representative may use the PGD 24 as a voice communication device. This voice interface 138 may be used to supplement some of the interfaces previously described. For example, when a game player spills a drink the game service representative may send maintenance request and receive a maintenance reply using the voice interface 138 on the PGD 24. As another example, when a game player requests to validate a food service such as free meal, such a request may be made by the player or a game service representative at a restaurant or other location using the voice interface 138 on the PGD 24. In one embodiment, a player may be permitted to contact a player of another PGD 24, such as by inputting a code number assigned to the PGD 24 through which communication is desired. Such would permit, for example, a husband and wife using two different PGDs 24 to communicate with one another. The voice interface 138 may also permit a player to contact the front desk of a hotel/casino, an operator of a switchboard at the gaming location or the like.

Another type of game service interface that may be stored on the PGD 24 is a game play interface 137. Preferably, a player is permitted to access the game play interface 137 in order to select from one or more games for play. The game play interface 137 may include a menu listing one or more games which the player may play via the PGD 24. Preferably, game play is facilitated with the game server 28 (see FIG. 1).

In one or more embodiments of the invention, the gaming control code is not resident at the PGD 24, but instead at a secure, remote server. Referring to FIG. 1, game play data is transmitted from the game server 28 to the PGD 24, and from the PGD 24 to the game server 28. Preferably, the PGD 24 is adapted to receive and process data, such as by receiving video data and processing the data to present the information on the display 102. Likewise, the PGD 24 is arranged to accept input and transmit that input or instruction to the game server 28. This arrangement has the benefit that nearly all aspects of the play of a game can be monitored, as it requires the game play data to pass to or from a remote location. This avoids, for example, storage of the gaming software at the PGD 24 where it might be tampered with, copied or the like.

In one or more embodiments, each PGD 24 has a unique identifier which is utilized to identify which PGD 24 data is transmitted from and to which data is to be transmitted to. In one embodiment, the game server 28 may thus be used to present the same or different games to a plurality of players using different PGDs 24, with the game data regarding a particular game being played at a particular PGD 24 being directed to that PGD 24 using its particular identifier.

As will be appreciated by those of skill in the art, the PGD 24 may have a variety of configurations. As stated above, the PGD 24 may be used in the gaming system 20 in which gaming code is not stored directly at the PGD. In such an embodiment, the PGD 24 may have a much more limited amount of data memory. In one embodiment, the PGD 24 includes a processor for executing control code, such as that necessary to operate the display 102, accept input from the stylus 103 or input buttons 104 or the like. In addition, the PGD 24 preferably includes a buffer memory for accepting data transmitted from the game server 28. This data may comprise data for displaying game information, such as video and sound content.

Various aspects of the use of the PGD 24 described above will now be described. In one or more embodiments, the PGD 24 may be used directly by a player. Preferably, a player may use the PGD 24 to play one or more games, and obtain products and services, such as food.

Figure 4A:
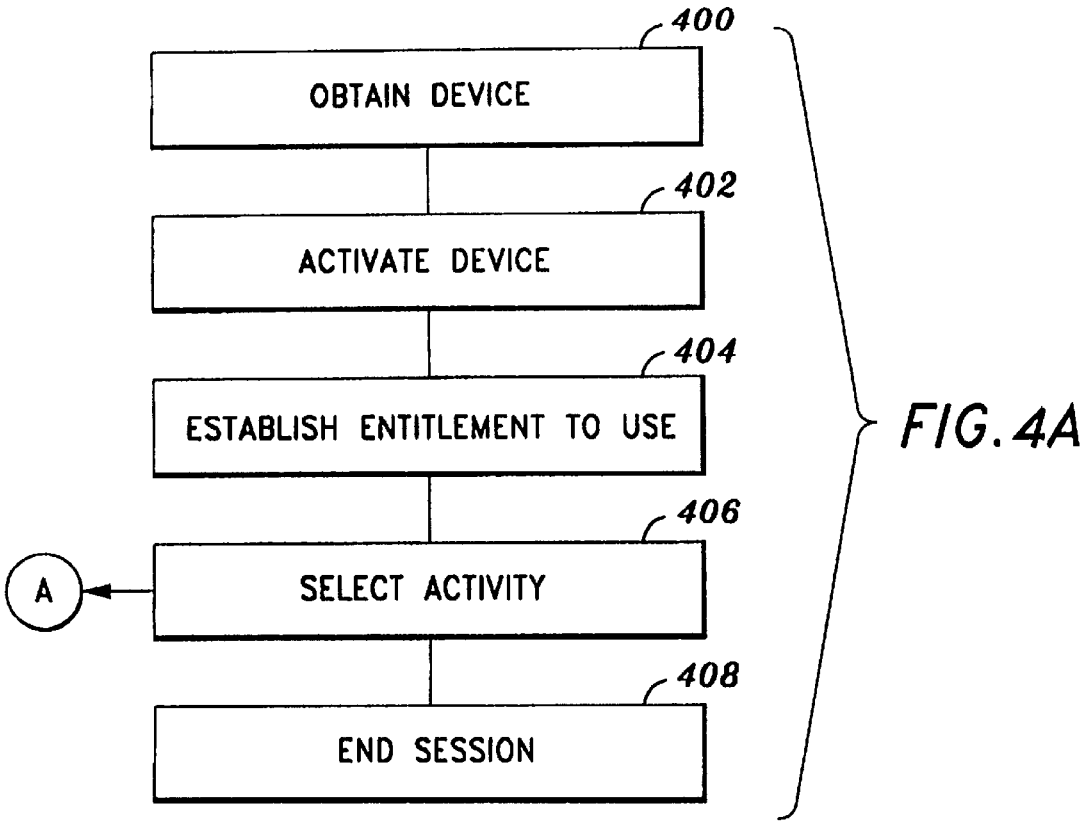
FIG. 4(*a*) is a flow diagram of a method of use of the portable gaming device of the invention by a player.
Figure 4B:
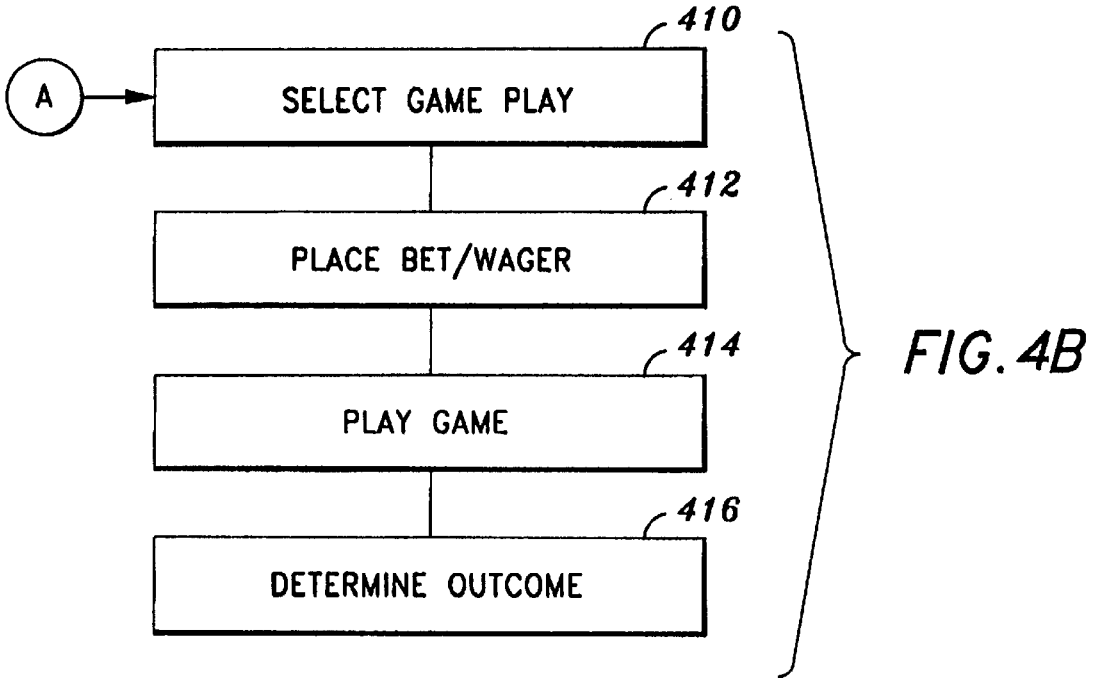

A method of use of the PGD 24 is described in detail below and illustrated in FIGS. 4(*a*) and 4(*b*). In general, a player must first obtain a PGD 24. For example, a player may check out a PGD 24 from a gaming operator. The player then establishes entitlement to use the PGD 24. In one embodiment, the player must indicate player status at the login interface, and obtain a valid ticket in order to activate the PGD 24. Once activated, the player is permitted to engage in a variety of transactions using the interfaces 106, such as playing a game, redeeming prizes and awards, placing food and drink orders, placing reservations, seeking gaming operator support and seeking a variety of other goods and services as described in more detail below.

One example of a method of use of the PGD 24 by a player will be described with reference to FIG. 4(*a*). In a first step 400, the player first obtains the PGD 24. In one embodiment, a gaming operator may have certain locations at which a player may obtain the PGD 24, such as the front desk of a hotel/casino, the hostess stand at a restaurant, from a gaming attendant or other location as desired. In one embodiment, a gaming operator may actually permit a player to retain the PGD 24, such as by renting, selling or giving the PGD 24 away to a player.

In a step 402, the PGD 24 is activated. In one embodiment, this step includes turning on the PGD 24 (such as with a power switch) and logging in. In one embodiment, when the PGD 24 is turned on, the login interface 105 is automatically displayed. The login interface 105 may include "player" and "authorized personnel" buttons which may be activated using the stylus 103. The player may indicate "player" status by selecting the player button with the stylus 103.

In one embodiment, the gaming operator may log the player in. For example, when a player obtains the PGD 24 from a hostess at a restaurant, the hostess may log in the player in player mode. In another embodiment, the gaming operator may have certain PGDs 24 which are for use by players and certain others which are for use by gaming personnel. In such event, the PGDs 24 which are configured for player status may automatically be configured for player mode after being turned on.

In a step 404, a player establishes entitlement to use the PGD 24. In one embodiment, this step comprises the player providing a valid ticket which is verifiable using the EZ pay portion of the gaming system 20. In one embodiment, a player may have obtained a ticket through play of a gaming machine, such as gaming machines 22*a*, 22*b*, 22*c*, 22*d*, 22*e*, 22*f*, 22*g*, 22*h*, 22*i*, 22*j* of the gaming system 20. In another embodiment, a player may be issued a ticket by a game service representative. For example, a player may provide credit at a cashier cage (such as with a credit card or cash) and be issued a ticket. A player may also pay cash or the like to a restaurant hostess and be issued a ticket.

Once the player has a ticket, the ticket may be scanned using the ticket reader 145 of the PGD 24. For example, the player may pass the ticket in front of the ticket reader 145. Once the information is read by the PGD 24, the data may be transmitted to the EZ pay server 26 for validation. Preferably, this validation confirms that the particular ticket is authorized, including the fact that it is outstanding and has value associated therewith.

In one or more embodiments, entitlement may be established in other manners. For example, in one embodiment, entitlement may be established with a player tracking or identification card which may be read using the card reader 140 of the PGD 24.

In general, establishing entitlement to use the PGD 24 is desirable because it ensures that the player has funds for paying to obtain services and products available by use of the PGD 24. Of course, in one or more embodiments, this step may be eliminated. For example, in one embodiment, a player may be permitted to use the PGD 24 and then pay for goods or services in other manners. In one embodiment, a player may, for example, order food and then pay the server for the food using a room charge or cash at the time the food is delivered. In another embodiment, a player may use a credit card to pay to play games or to pay for food or the like. In such event, a credit card may be read by the card reader 140 at the time the services or products are to be provided or are ordered by the player.

In a step 406, the player is then permitted to select one or more selections from the interfaces 106. As stated above, a player may not be permitted access to all of the interfaces 106. In any event, a player may select, such as with the stylus 103, a service from the group of interfaces 106. An example of the engagement of a particular activity using the PGD 24 will be described below with reference to FIG. 4(*b*).

Once a player no longer desires to engage in any more activities using the PGD 24, the use session of the PGD 24 is ended in a step 408, and in one or more embodiments, the PGD 24 is returned to the gaming operator. Preferably, once a player no longer wishes to use the PGD 24, the player returns the PGD 24 to the gaming operator. At that time, the gaming operator may confirm that all transactions using the PGD 24 are closed or complete, and pay the player any winnings. In one embodiment, a player 24 is issued a new ticket representing the player's credit (including any payments made in order to first use the PGD 24, plus any winnings, less any expenditures).

An example of a method of using the PGD 24 wherein the player has selected the option of game play using the game play interface 137 will be described in detail with reference to FIG. 4(*b*). In a step 410 (which step comprises a particular embodiment of step 406 of FIG. 4(*a*)), a player has selected the event or service of "game play" using the game play interface 137.

In one embodiment, when a player has selected the game play interface 137, a menu may be displayed to the player of the one or more games which the player may be permitted to play. In one embodiment, when the player selects the game play interface 137, a signal is transmitted from the PGD 24 to the remote game server 28 instructing the game server 28 that the player wishes to play a game. In response, the game server 28 may send the latest game menu to the PGD 24 for display. In this arrangement, the menu of games which is available may be continuously updated at one or more central locations (such as the server 28) instead of at each PGD 24.

If the system 20 permits the player to select a game from a menu of games, then the method includes the step of the player selecting a particular game to be played. Once a game is selected, or if only a single game option is provided, then game play begins. In a preferred embodiment, the game server 28 transmits data to the PGD 24 for use by the PGD 24 in presenting the game, such as video and audio content.

In a preferred embodiment, in a step 412 a player is required to place a bet or ante to participate in a game. In one embodiment, the player may place the bet or ante using the EZ pay system. As stated above, the player preferably establishes entitlement to use the PGD 24 with an EZ pay ticket or other entitlement, which ticket demonstrates that the player has monies or credits on account which may be used to pay for goods and services. These services include game play services.

In one embodiment, when the player establishes entitlement to use the PGD 24, the value of the player's credits or monies are displayed to the player so that the player is visually reminded of these amounts. When a player begins play of a game, the player may input a bet and ante which is no more than the value of the credits or monies which the player has on account. Once a player has placed a bet or ante, that information is transmitted to the EZ pay server 26 and is deducted from the player's account. A new credit value is then displayed at the PGD 24 to the player.

In an alternate embodiment, a player may provide credit for a bet or ante in other manners. For example, a player may swipe a credit card through the card reader 140 in order to provide the necessary credit for the bet or ante.

In a step 414, the player is then permitted to engage in the game. In a preferred embodiment, game play comprises the game server 28 executing game code and transmitting information to the PGD 24 for presenting certain aspects of the game to the player. When necessary, the player is permitted to provide input, and the input data is transmitted from the PGD 24 to the game server 28.

As one example of a game, the game may comprise video poker. In this embodiment, the game server 28 executes code for randomly generating or selecting five cards. Data representing video images of the cards is transmitted to the PGD 24, where the images of the five dealt cards are displayed on the display screen 102.

The instruction "draw" or "stay" may be displayed to the player. At that time, the player may select one or more of the cards to hold or replace. In the event the player elects to replace any card, that instruction is transmitted to the game server 28 which then randomly generates or selects replacement cards. The replacement card data is transmitted to the PGD 24 and images of the replacement cards are displayed.

In the event the hand of five cards (including any replacement cards) is determined by the game server 28 to comprise a predetermined winning hand, then the player may be paid a winning amount. If not, then the player loses his bet or ante. This step comprises step 416 of the method, that of determining the outcome of the game.

If the outcome is a winning outcome, then the player may be paid a winning by crediting the player's account through the EZ pay server 26. In that event, the player's credits value as displayed is updated to reflect the player's winnings.

A player may then elect to play the game again, play a different game, or select one or more other services offered. In one embodiment, a "return to main menu" button or the like may be displayed to the player at all times, permitting the player to return to a display including the various interfaces 106.

As stated above, in one embodiment, when the player has completed use of the PGD 24, the player returns the PGD 24 to the gaming operator. For example, the player may return the PGD 24 to a cashier cage or a game service operator. Preferably, the game service operator or other party then issues the player a ticket for any credit or value which remains in the player's account. The PGD 24 may then be deactivated so that it readied for use by another player. In one embodiment, the PGD 24 may be deactivated by turning its power off. In another embodiment, a "logout" interface or option may be provided which causes the PGD 24 to return to a default state seeking the login of a player or user.

The PGD 24 may be used by a game service operator. Several examples of a method of such use are detailed below in conjunction with FIGS. 5 and 6.

When a game service representative contacts a game player seeking a game service in the game playing area 70 (see FIG. 1), the game service representative uses an appropriate game service interface on the display screen of the PGD 24, as described with reference to FIG. 3, to provide the game service requested by the game player. For example, when a game player requests an EZ pay ticket validation, the game service representative brings the EZ pay ticket validation interface onto the display screen of the PGD 24 using menus available on the display screen 102. Then, the game service representative scans the EZ pay ticket using a ticket reader connected to the PGD 24 to obtain unique ticket information. Next, the PGD 24 sends an EZ pay ticket validation request using the wire-less communication interface to the EZ pay server 26.

Typically, the ticket validation request is composed of one or more information packets compatible with the wire-less communication standard being employed. Using a wireless link 72, the one or more information packets containing the ticket validation request are sent to the transceiver 62 connected to the EZ pay server. The transceiver 62 is designed to receive and send messages from the one or more PGDs 24 in the game playing area 70 in a communication format used by the PGDs. Depending on the location of the PGD 24 in the game playing area 70, the communication path for the information packets to and from the PGD 24 may be through one or more wire-less communication relays including 58 and 60. For example, when the PGD 24 is located near gaming machine 22*a*, the communication path for a message from the PGD 24 to the EZ pay server 26 may be from the PGD 24 to the relay 60, from the relay 60 to the relay 58, from the relay 58 to the transceiver 62 and from the transceiver 62 to the EZ pay server 26. As the location of the PGD 24 changes in the game playing area 70, the communication path between the PGD 24 and the EZ pay server 26 may change.

After receiving an EZ pay ticket validation reply from the EZ pay server 26, the EZ pay ticket may be validated using an appropriate display screen on the PGD 24. After cashing out the ticket, the game service representative may send a confirmation of the transaction to the EZ pay server 26 using the PGD 24. The transaction history for the PGD 24 may be stored on the PGD 24 as well as the EZ pay server 26. Next, a receipt for the transaction may be printed out. The receipt may be generated from a portable printer carried by the game server representative ad connected to the PGD 24 in some manner or the receipt may be generated from a printer 56 at a fixed location.

After providing a number of game services comprising a number of game service transactions to different game players in the game playing area 70 using the PGD 24, a game service representative may log-off of the PGD 24 and return it to location for secure storage. For example, at the end of a shift, the game service representative may check the PGD 24 at some of the locations, the device is unassigned to the particular game service representative and then may be assigned to another game service representative. However, before the PGD 24 is assigned to another game service representative, the transaction history stored on the PGD 24 may be reconciled with a separate transaction history stored on a transaction server such as the EZ pay server 26.

The assigning and unassigning of the PGD 24 to a game service representative and the transaction reconciliation are performed for security and auditing purposes. Another security measure which may be used on the PGD 24 is a fixed connection time between the PGD 24 and a transaction server. For example, after the PGD 24 has been assigned to a game service representative and the game service representative has logged on the PGD 24, the PGD 24 may establish a connection with one or more transaction servers including the EZ pay server 26, a server 28, a server 30, or a server 32. The connection between a transaction server and the PGD 24 allows the PGD 24 to send information to the transaction server and receive information from the transaction server. The length of this connection may be fixed such that after a certain amount of time the connection between the PGD 24 and the transaction server is automatically terminated. To reconnect to the transaction server, the login and registration process must be repeated on the PGD 24.

A transaction server may provide one or more game service transactions. However, the PGD 24 may connect with multiple transaction servers to obtain different game service transactions. For example, server 30 may be a prize transaction server allowing prize service transactions and server 415 may be a food transaction server allowing food service transactions. When a game service representative receives a prize service request from a game player, the PGD 24 may be used to contact the prize transaction server 30 using a wire-less communication link between the PGD 24 and a transceiver 64 connected to the prize transaction server 30. Similarly, when a game service representative receives a food service request from a game player, the PGD 24 may be used to contact the food transaction server 32 using a wire-less communication link between the PGD 24 and a transceiver 66 connected to the food transaction server 32.

The different transaction servers including the servers 26, 28, 30, 32 may be on separate networks or linked in some manner. For example, server 32 is connected to network 74, server 26 is connected to network 38, server 30 is connected to network 76, and server 28 is connected to network 78. In this embodiment, a network link 80 exists between network 76 and network 38. Thus, server 26 may communicate with server 30 via the network link 80. A communication link between different servers may allow the servers to share game service transaction information and allow different communication paths between the PGDs and the transaction servers. Likewise, a network link 82 exists between network 78 and network 38, permitting the game server to communicate with the EZ pay server 26.

Figure 5:
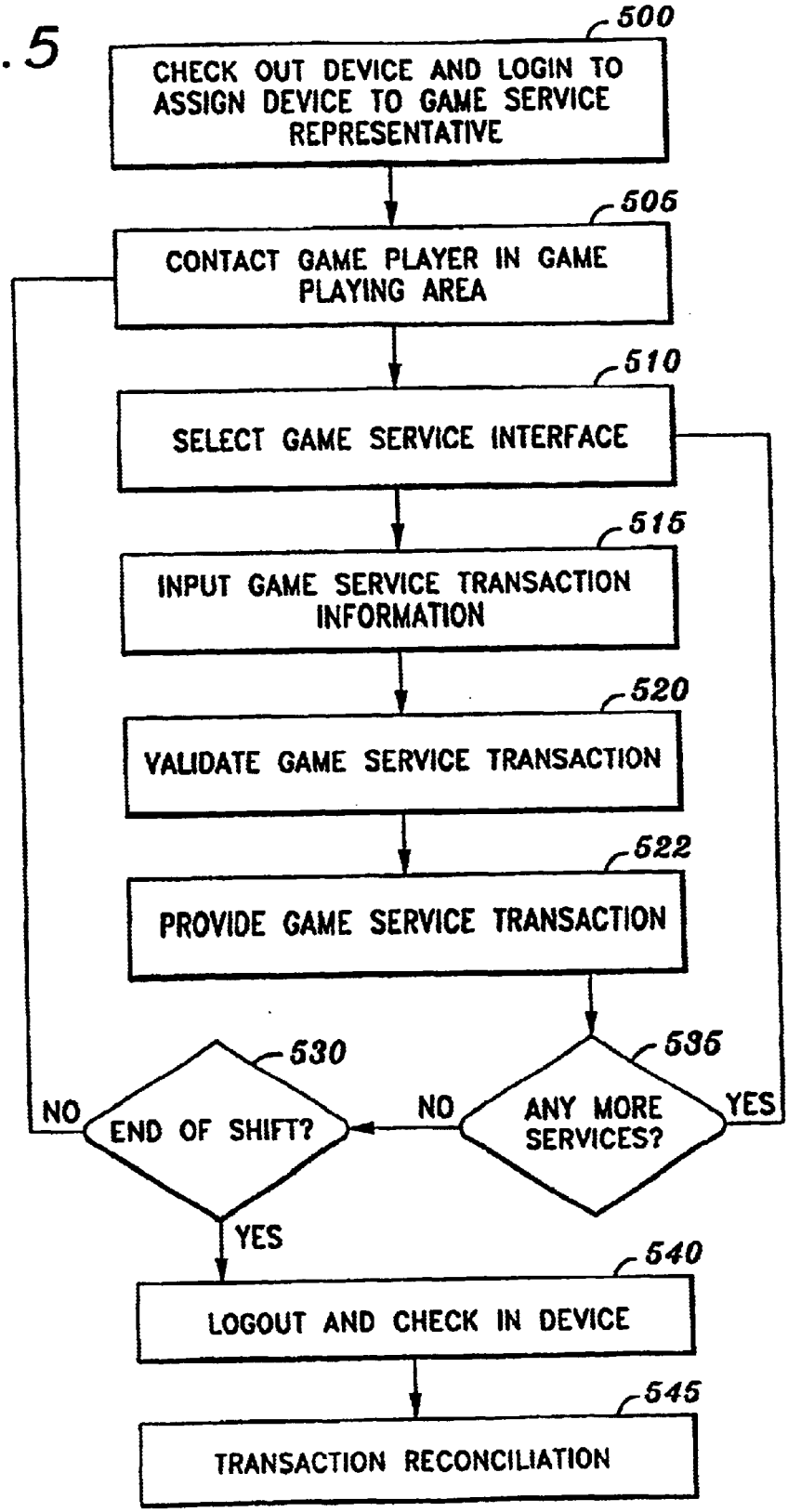
FIG. 5 is a flow diagram of a method of use of the portable gaming device of the invention by a gaming service operator.

FIG. 5 is a flow chart depicting a method for providing a game service using a hand-held device. In step 500, a game service representative receives the PGD 24 and logs in to the device to assign the device. The check out process and assign process are for security and auditing purposes. In a step 505, the game service representative contacts a game player in the game playing area requesting a game service of some type. In a step 510, the game service representative selects an appropriate interface on the PGD 24 using menus on the display screen 102 of the PGD that allow the game service representative to provide a requested game service. In a step 515, the game service representative inputs game service transaction information required to perform a game service transaction. For example, to validate an award ticket, the game service representative may read information from the ticket using a ticket reader. As another example, to provide a food service including dinner reservation, the game service representative may enter a game player's name to make the reservation.

In a step 520, the transaction information obtained in step 515 is validated as required. For example, when a player attempts to cash out an award ticket, the information from the award is validated to ensure the ticket is both genuine (e.g. the ticket may be counterfeit) and has not already been validated. The validation process requires a number of transfers of information packets between the PGD 24 and the transaction server. The details of the validation process for an award ticket validation are described with reference to FIG. 6. When the transaction information is valid, in a step 522, a game service transaction is provided. For example, a room reservation may be made for a player requesting an accommodation service. A confirmation of the game service transaction may be sent to the transaction server for transaction reconciliation in a step 545. In one or more embodiments, the method may include the step of generating a receipt regarding the game service transaction.

In a step 535, after providing the service, a game player may request another game service. When a game player requests an additional game service, the game service representative returns to step 510 and selects an appropriate interface for the game service. When a game player does not request an additional service and it is not the end of a shift, in a step 530, the game service representative returns to step 505 and contacts a new game player. In a step 540, when a shift has ended, the game service representative logs out of the PGD 24 and checks the device at a secure location so that the PGD may be assigned to a different game service representative. In step 545, before the PGD 24 is assigned to a different game service representative, a transaction history reconciliation is performed to ensure that the transaction history stored on the PGD is consistent with the transactions previously confirmed with a transaction server during the game service representative's shift. The transaction history on the PGD 24 may be stored on a removable memory storage device on the PGD. Thus, the memory may be removed from the device for transaction reconciliation and replaced with a new memory. Thus, the device with the new memory may be assigned to a new game service representative while the transaction history from the previous game service representative assigned to the device is reconciled.

Figure 6:
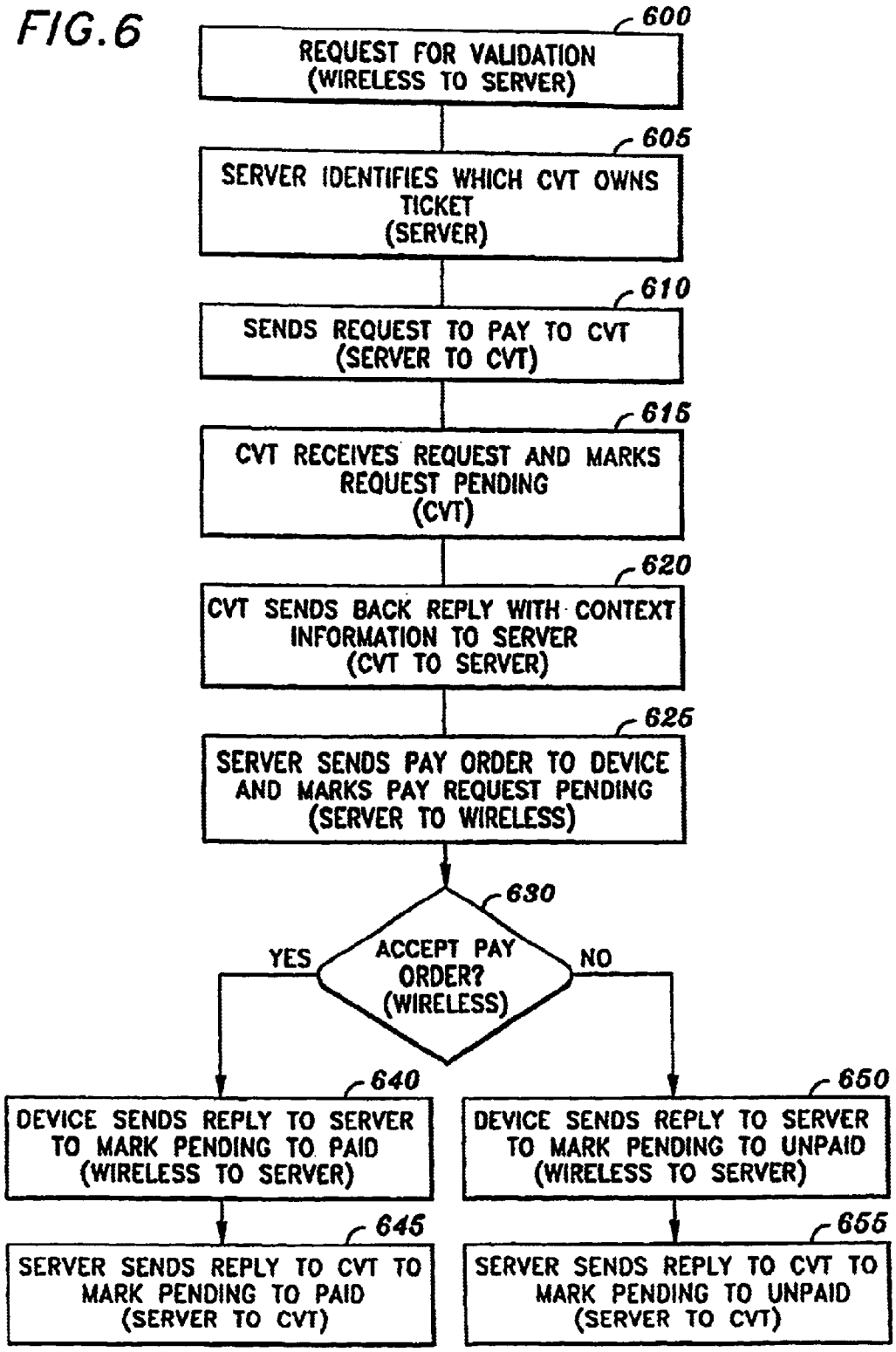
FIG. 6 is a flow diagram of yet another method of use of the portable gaming device of the invention by a gaming service operator.

FIG. 6 is a flow chart depicting a method for validating information for providing a personal game service. In the embodiment shown in the figure, a ticket is validated in a manner consistent with an EZ pay ticket system. The EZ pay ticket is usually used for award tickets. However, the system may be adapted to provide tickets for other services include food services, prize services or accommodation services. In a step 600, a request for game service transaction information read from a ticket is sent via a wire-less communication interface on the PGD 24 to the appropriate transaction server as described with reference to FIG. 1. In a step 605, the server identifies which clerk validation ticket (CVT) 34,36 owns the ticket. When a CVT owns a ticket, the CVT has stored information regarding the status of a particular ticket issued from a gaming machine connected to the CVT 34,36. In a step 610, the server sends a request to pay the ticket to the CVT identified as the owner of the ticket. Typically, the pay request indicated a service on the ticket has been requested. For a cash ticket, a pay request means a request to cash out the ticket has been made. For a free meal, a pay request means a request to obtain the meal has been made. In a step 615, the CVT receives the pay request for the ticket and marks the ticket pending. While the ticket is pending, any attempts to validate a ticket with similar information is blocked by the CVT.

In a step 620, the CVT 34,36 sends back a reply with context information to the server. As an example, the context information may be the time and place when the ticket was issued. The information from the CVT to the server may be sent as one or more data packets according to a communication standard shared by the CVT and server. In a step 625, after receiving the validation reply from the CVT, the server marks the pay request pending and sends a pay order to the PGD 24. While the pay request is pending, the server will not allow another ticket with the same information as the ticket with the pay request pending to be validated.

In a step 630, the game service representative may choose to accept or reject the pay order form the server. When the game service representative accepts the pay order from the server, in a step 640, the PGD 24 sends a reply to the transaction server confirming that the transaction has been performed. The transaction server marks the request paid which prevents another ticket with identical information from being validated. In a step 645, the server sends a confirmation to the CVT which allows the CVT to mark the request from pending to paid. When the game service representative rejects the pay order from the server, in a step 650, the PGD 24 sends a reply to the server to mark the pay request from pending to unpaid. When the ticket is marked unpaid, it may be validated by another PGD 24 or other validation device. In a step 655, the server sends the reply to the CVT to mark the pay request from pending to unpaid which allows the ticket to be validated.

As described above, in one or more embodiments of the invention, a ticket may be used to provide credit/value for establishing entitlement to a service or a good, such as the right to play a game or obtain food. As detailed above, the PGD 24 may include a card reader 140. In such an arrangement, a user of the PGD 24 may use a credit card or other magnetic stripe type card for providing credit/value. Alternatively, the PGD 24 may include one or more other types of devices for obtaining/receiving information, such as a smart card reader. In such arrangements, the PGD 24 device may read information from the credit card, smart card or other device. These cards may comprise the well known credit or debit cards. This information may be used to provide the credit/value. In the example of a credit card, the user's account information may be read from the card and transmitted from the PGD 24 to the controller 42. Credit card/credit validation information may be associated with a credit card server (not shown). This credit card server may be associated with a bank or other entity remote from the casino or place of use of the PGD 24 and the controller 42. A communication link may be provided between the controller 42 and remote server for sending credit card information there over.

In one embodiment, when a player utilizes a smart card or credit card the amount of associated credit or value may be transmitted to the EZ Pay server 26, and then the credited amount may be treated in exactly the same manner as if the credit/value had been provided by a ticket. When a player wishes to cash out, the EZ Pay server 26 has a record of the original amount credited and the amounts of any awards, losses or payments, and may then issue the player a ticket representing the user's total credit.

In accordance with the invention, a gaming system is provided which includes one or more portable gaming devices. The portable gaming devices permit a player to play one or more games at a variety of locations, such as a hotel room, restaurant or other location. These locations may be remote from traditional gaming areas where free-standing, generally stationary gaming machines are located.

In one or more embodiments, a player may use the portable gaming device to not only play games, but obtain other products and services. In addition, in one or more embodiments, the portable gaming device may be used by game service representatives to perform a variety of functions and provide a variety of services to a player.

It will be understood that the above described arrangements of apparatus and the method therefrom are merely illustrative of applications of the principles of this invention and many other embodiments and modifications may be made without departing from the spirit and scope of the invention as defined in the claims.

We claim:

1. A method of presenting wagering games to a plurality of players in a mobile gaming environment comprising:

distributing a plurality of hand-held gaming devices to a plurality of players, said hand-held gaming devices including a ticket reader, at least one display and a data processor;

accepting selection by a player of a game to be played at each hand-held gaming device, said game selected from a group of possible games and said game selectable independent of a game selected by other players of said hand-held gaming devices;

reading ticket information from a player-provided ticket but not storing said ticket with said ticket reader at each hand-held gaming device;

transmitting said ticket information to a ticket processing server over a communication link, at least a portion of which is wireless;

verifying said ticket information and associated credits at said ticket processing server;

accepting a wager by said player of each hand-held gaming device using credits associated with said ticket provided by said player;

transmitting game code from a gamer server to each hand-held gaming device over a communication link, at least a portion of which is wireless, said game code associated with the particular game which was selected by said player; and executing said game code using said processor of said hand-held gaming device to present said game to said player thereof, said presentation of said game at each hand-held gaming device being independent of the games presented at the other hand-held gaming devices.

2. The method in accordance with claim 1 including the step of displaying a player interface at said hand-held gaming device, said interface including information identifying said plurality of games which the player may select to play.

3. The method in accordance with claim 1 wherein said step of reading said ticket information comprises reading a bar code on said ticket.

4. The method in accordance with claim 1 wherein said steps are performed at different times with respect to each hand-held gaming device.

5. A mobile gaming system comprising:

one or more ticket generating devices configured to generate a ticket having associated value;

a plurality of hand-held gaming devices configured to present games independent of one another, said hand-held gaming devices including at least one display configured to display game information to a player, at least one input for receiving player input, and a ticket reader configured to read but not store a ticket generated by one of said ticket generating devices, said value of said ticket usable by the player in placing a wager to play a game on said hand-held gaming device;

a game server configured to transmit game code to each hand-held gaming device independently of the others, the game code transmitted to a particular hand-held gaming device pertaining to a particular game selected by a player thereof, permitting players of the hand-held gaming devices to play games on said hand-held gaming devices independently of one another;

a communication link between said game server and each hand-held gaming device over which said game code is transmitted from said game server to each hand-held gaming device, at least a portion of said communication link comprising a wireless communication link;

a ticket processing server configured to store ticket information including information regarding value associated with a particular ticket and to verify use of a ticket presented to one of said hand-held gaming devices in making a game play wager; and a communication link between said ticket processing server and each hand-held gaming device over which ticket information regarding a ticket read by said hand-held gaming device is transmitted to said ticket processing server.

6. The gaming system in accordance with claim 5 wherein said ticket reader comprises a bar code reader.

7. The gaming system in accordance with claim 5 wherein said game server is configured to transmit game code corresponding to a particular game selected from a group of possible games to be played by a player of a specific hand-held gaming device.

8. The gaming system in accordance with claim 5 wherein said hand-held gaming devices are configured to read but not print said tickets.

9. The gaming system in accordance with claim 5 wherein said communication link between said game server and one or more of said hand-held devices includes one or more wireless communication relays enabling said communications with said hand-held devices remote from said game server.

* * * * *